US005529414A

United States Patent [19]

Katano et al.

[11] Patent Number: 5,529,414

[45] Date of Patent: Jun. 25, 1996

[54] PAPER FEEDING APPARATUS FOR PRINTER

[75] Inventors: Keiji Katano, Iwate-ken; Toshiyuki Chiba, Furukawa, both of Japan

[73] Assignee: Alps Electric Co., Ltd., Tokyo, Japan

[21] Appl. No.: 482,527

[22] Filed: Jun. 7, 1995

[30] Foreign Application Priority Data

Jun. 24, 1994 [JP] Japan ..... 6-143190
Jul. 14, 1994 [JP] Japan ..... 6-161888

[51] Int. Cl.[6] ..... B41J 13/02

[52] U.S. Cl. ..... 400/636.2; 271/266

[58] Field of Search ..... 271/266, 264, 271/275, 314; 400/582, 583, 615, 636.2, 636, 636.1

[56] References Cited

U.S. PATENT DOCUMENTS

| | | | |
|---|---|---|---|
| 4,217,057 | 8/1980 | Nakamura | 400/636 |
| 4,266,880 | 5/1981 | Buchanan | 400/550 |
| 4,538,933 | 9/1985 | Imaizumi et al. | 400/582 |
| 4,581,618 | 4/1986 | Watanabe et al. | 346/134 |
| 4,929,105 | 5/1990 | Hirayama et al. | 400/625 |
| 4,930,916 | 6/1990 | Fujiwara | 400/636 |
| 4,934,845 | 6/1990 | Kato | 400/582 |
| 5,030,024 | 7/1991 | Seshimo | 400/605 |
| 5,209,590 | 5/1993 | Tsukuda et al. | 400/636.1 |
| 5,297,871 | 3/1994 | Fujioka | 400/568 |
| 5,397,191 | 3/1995 | Murakami et al. | 400/636.1 |

FOREIGN PATENT DOCUMENTS

| | | | |
|---|---|---|---|
| 0584792 | 3/1994 | European Pat. Off. | 400/582 |
| 2286369 | 11/1990 | Japan | 400/582 |

*Primary Examiner*—William E. Terrell
*Assistant Examiner*—Tamara Kelly
*Attorney, Agent, or Firm*—Guy W. Shoup; Patrick T. Bever

[57] ABSTRACT

The present invention provides a paper feeding apparatus for a printer wherein a paper feed roller can be driven to rotate with a high degree of accuracy to achieve feeding of a paper sheet with a very high degree of accuracy. The paper feeding apparatus for a printer comprises a paper feed motor constituted from a stepping motor, a motor gear driven to rotate by the paper feed motor, a paper feed roller disposed for rotation for transporting a recording sheet to a printing position, the length of an outer periphery of the paper feed roller being set equal to N line feed distances, a paper feed gear for driving the paper feed roller to rotate, at least one transmission gear for transmitting rotating force of the motor gear to the paper feed gear, a detection element formed on the paper feed roller and indicating a reference position of the paper feed roller, a detector for detecting the detection element and generating a detection signal, and a control apparatus for receiving the detection signal from the detector and controlling driving of the paper feed motor so that, upon starting of paper feeding, the paper feed roller may be positioned normally at the reference position.

4 Claims, 4 Drawing Sheets

PAPER FEEDING APPARATUS FOR PRINTER

BACKGROUND OF THE INVENTION

1. Field of the Invention

This invention relates to a paper feeding apparatus for a printer, and more particularly to a paper feeding apparatus for a printer by which paper can be fed with a high degree of accuracy.

2. Description of the Prior Art

Various printers have conventionally been used wherein a print head is driven in response to a desired printing signal to perform desired printing on paper.

FIG. 5 shows one of such conventional popular printers. Referring to FIG. 5, a platen 2 in the form of a flat plate is disposed at a substantially central location of a frame 1 of the printer such that a printing face thereof extends substantially vertically. A carriage shaft 3 is disposed in parallel to the platen 2 at a location of the frame 1 forwardly below the platen 2. A guide portion 4 in the form of a flange is formed at a front end edge of the frame 1, and a carriage 5 is mounted on the carriage shaft 3 and the guide portion 4 for back and forth movement along the carriage shaft 3 and the guide portion 4. A print head 6 is mounted at an end portion of the carriage 5 such that it is opposed to the platen 2 and is driven to move into and out of contact with the platen 2 by a driving mechanism not shown. A ribbon cassette (not shown) in which an ink ribbon is accommodated is removably mounted on an upper face of the carriage 5 such that the ink ribbon therein is guided between the print head 6 and the platen 2. Further, a take-up bobbin 7 for taking up the ink ribbon of the ribbon cassette and a supply bobbin 8 for supplying the ink ribbon are disposed on the upper face of the carriage 5.

A paper insertion opening 9 is formed rearwardly of the platen 2 for feeding a paper sheet (not shown) to a location forwardly of the platen 2 therethrough, and a pair of paper feed rollers 10 for transporting the paper sheet at a predetermined speed are disposed adjacent the paper insertion opening 9. A pair of contact rollers 11 are disposed for rotation below the paper feed rollers 10 such that they are individually contacted under pressure by the paper feed rollers 10. A paper feed gear 12 is disposed projectingly on one side face of the frame 1 and is mounted coaxially with the paper feed rollers 10. A motor gear 15 of a paper feed motor 14 is connected to the paper feed gear 12 by way of a plurality of transmission gears 13 so that, when the paper feed motor 14 is energized, the paper feed rollers 10 are rotated by way of the motor gear 15, the transmission gears 13 and the paper feed gear 12 so that a paper sheet which has been inserted through the paper insertion opening 9 and is held between the paper feed rollers 10 and the contact rollers 11 is transported by the paper feed rollers 10 and the contact rollers 11.

In the conventional printer described above, a paper sheet is inserted through the paper insertion opening 9 until it is held between the paper feed rollers 10 and the contact rollers 11, and the paper feed rollers 10 are driven to rotate by the paper feed motor 14 so that the paper sheet is transported at a predetermined speed in a direction perpendicular to the direction of movement of the carriage 5. Further, while the print head 6 is held in contact under a predetermined pressing force with the paper sheet, the carriage 5 is moved and the take-up bobbin 7 is rotated to take up the ink ribbon of the ribbon cassette while the print head 6 is driven in response to a desired printing signal to perform desired printing on the paper sheet.

In the conventional printer of the construction described above, however, since the motor gear 15, the transmission gears 13 and the paper feed gear 12 are set to a predetermined gear ratio so that, when a paper sheet is fed, the paper feed rollers 10 can be driven to rotate by an amount equal to a predetermined one line feed (line space) distance in response to rotation of the paper feed motor 14, for example, if the paper feed motor 14 is driven to rotate the motor gear 15 in order to rotate the paper feed rollers 10 by an amount equal to the one line feed distance from a condition shown in FIG. 6A, then the amounts of rotation of the motor gear 15, the transmission gears 13 and the paper feed gear are different from one another as seen from FIG. 6B. Consequently, even if the motor gear 15 is driven to rotate with a high degree of accuracy by the paper feed motor 14, the paper feed gear 12 suffers from a great error in rotation arising from errors in dimension of and errors in meshing engagement between the motor gear 15, the transmission gears 13 and the paper feed gear 12. Accordingly, the conventional printer is disadvantageous in that a high degree of accuracy cannot be assured in feeding of a paper sheet by the paper feed rollers 10.

Therefore, in order to drive the paper feed rollers 10 with a high degree of accuracy, all of the motor gear 15, the transmission gears 13 and the paper feed gear 12 must be produced with a high degree of accuracy. This, however, is actually very difficult, and it is very difficult to assure a high degree of accuracy in feeding of a paper sheet.

SUMMARY OF THE INVENTION

It is an object of the present invention to provide a paper feeding apparatus for a printer wherein a paper feed roller can be driven to rotate with a high degree of accuracy to achieve feeding of a paper sheet with a very high degree of accuracy even where transmission gears have errors in dimension and so forth.

In order to attain the object described above, according to an aspect of the present invention, there is provide a paper feeding apparatus for a printer, comprising:

- a paper feed motor constituted from a stepping motor;
- a motor gear driven to rotate by the paper feed motor;
- a paper feed roller disposed for rotation for transporting a recording sheet to a printing position;
- a paper feed gear for driving the paper feed roller to-rotate; and
- at least one transmission gear for transmitting rotating force of the motor gear to the paper feed gear;
- the length of an outer periphery of the paper feed roller being set equal to N line feed distances;
- the gear ratio of the motor gear, the transmission gear and the paper feed gear being set so that the transmission gear may stop normally at a rotation starting position by 1/N rotation of the paper feed roller.

The paper feeding apparatus for a printer may further comprise:comprising:

- a detection element formed on the paper feed roller and indicating a reference position of the paper feed roller;
- a detector for detecting the detection element and generating a detection signal; and
- a control apparatus for receiving the detection signal from the detector and controlling driving of the paper feed motor so that, upon starting of paper feeding, the paper feed roller may be positioned normally at the reference position.

In the paper feeding apparatus for a printer according to the present invention, upon starting of paper feeding, the paper feed motor is energized to rotate the paper feed roller by way of the motor gear, the transmission gear and the paper feed gear. Then, when the detection element of the paper feed motor is detected by the detector, the paper feed motor is stopped by the control apparatus in response to such detection signal from the detector to position the paper feed roller at the reference position. Thereafter, the paper feed motor is energized to rotate the paper feed gear by way of the motor gear and the transmission gear thereby to rotate the paper feed roller to successively transport the recording sheet by a predetermined amount to perform line feeding of the recording sheet. In this instance, since the gear ratio of the transmission gear is set so that, when the paper feed roller is rotated by an amount equal to a 1/N line feed distance, the transmission gear is stopped normally at the rotation starting position, the transmission gear rotates by an integral number of times without fail after starting until completion of rotation of the motor gear. Consequently, when rotation of the motor gear is transmitted to the paper feed gear, even where the transmission gear has an error in accuracy in dimension and/or an error in meshing engagement, the transmission of rotation is not influenced by such error or errors at all, and consequently, the accuracy in paper feeding can be raised remarkably. Further, since the paper feed roller is positioned normally at the reference position upon starting of paper feeding, when the paper feed roller is rotated, the paper feed roller will be rotationally positioned normally at one of predetermined positions. Consequently, even if an error in dimension occurs with the outer periphery of the paper feed roller due to eccentricity or the like, paper feeding can be performed with a fixed error amount.

According to another aspect of the present invention, there is provided a paper feeding apparatus for a printer, comprising:

a paper feed motor constituted from a stepping motor;

a motor gear driven to rotate by the paper feed motor;

a paper feed roller disposed for rotation for transporting a recording sheet to a printing position, the length of an outer periphery of the paper feed roller being set equal to N line feed distances;

a paper feed gear for driving the paper feed roller to rotate;

at least one transmission gear for transmitting rotating force of the motor gear to the paper feed gear;

a detection element formed on the paper feed roller and indicating a reference position of the paper feed roller;

a detector for detecting the detection element and generating a detection signal;

storage means for storing N corrected driving pulse numbers of the paper feed motor, which are corrected so that the paper feeding amounts by individual line feeding operations may be a fixed value based on the eccentric condition of the paper feed roller, corresponding to N line feeding operations; and a control apparatus for receiving the detection signal from the detector and controlling driving of the paper feed motor so that, upon starting of paper feeding, the paper feed roller may be positioned normally at the reference position and for controlling driving of the paper feed motor successively in accordance with the corrected driving pulse numbers stored in the storage apparatus.

The paper feeding apparatus for a printer may further comprise a paper detector for detecting presence or absence of a paper sheet being transported, the paper detector being disposed at a location on the upstream side of the printing position in the paper feeding direction at which the distance from the printing position is substantially equal to an integral number of times the one line feed distance.

In the paper feeding apparatus for a printer according to the present invention, when the paper feed motor is energized to rotate the paper feed roller by way of the motor gear, the transmission gear and the paper feed gear until the detection element of the paper feed roller is detected by the reference position detector, the paper feed roller is stopped by the control apparatus in response to such detection signal from the detector to position the paper feed roller at the reference position. Then, a paper sheet is fed until a leading end portion thereof is detected by the paper detector, and then the number of driving pulses to be outputted to the paper feed motor is controlled by the control apparatus in accordance with the first corrected driving pulse number stored in the storage apparatus so that the paper feed roller is driven to feed the paper sheet to the printing starting position to thus perform indexing of the paper sheet. In this instance, since the distance from the paper detector to the printing starting position is set equal to an integral number of times the one line feed distance, as the control apparatus controls the number of pulses to be outputted to the paper feed motor in accordance with the corrected driving pulse numbers stored in the storage apparatus, accurate paper feeding can be performed with the corrected paper feeding amount.

Then, after printing for one line is completed, the paper feeding motor is energized by the control apparatus in accordance with a corresponding one of the corrected driving pulse numbers stored in the storage apparatus to rotate the paper feed roller by a one line feed distance to perform line feeding of the paper sheet. When line feeding is performed in this manner, the paper feed motor is driven in accordance with the corresponding corrected driving pulse number stored in the storage apparatus to drive the paper feed roller, and after the paper feed roller makes one full rotation by performing such line feeding operation repetitively by N times, a line feeding operation is performed successively in accordance with the corrected driving pulse numbers of the storage apparatus beginning with the first one of the corrected driving pulse numbers. Consequently, even if the paper feed roller is formed in a somewhat eccentric condition, accurate paper feeding can be performed in accordance with the corrected paper feeding amounts.

DETAILED DESCRIPTION OF THE PREFERRED EMBODIMENTS

A first preferred embodiment of the present invention will be described below with reference to FIGS. 1, 2A and 2B.

Figure 1:
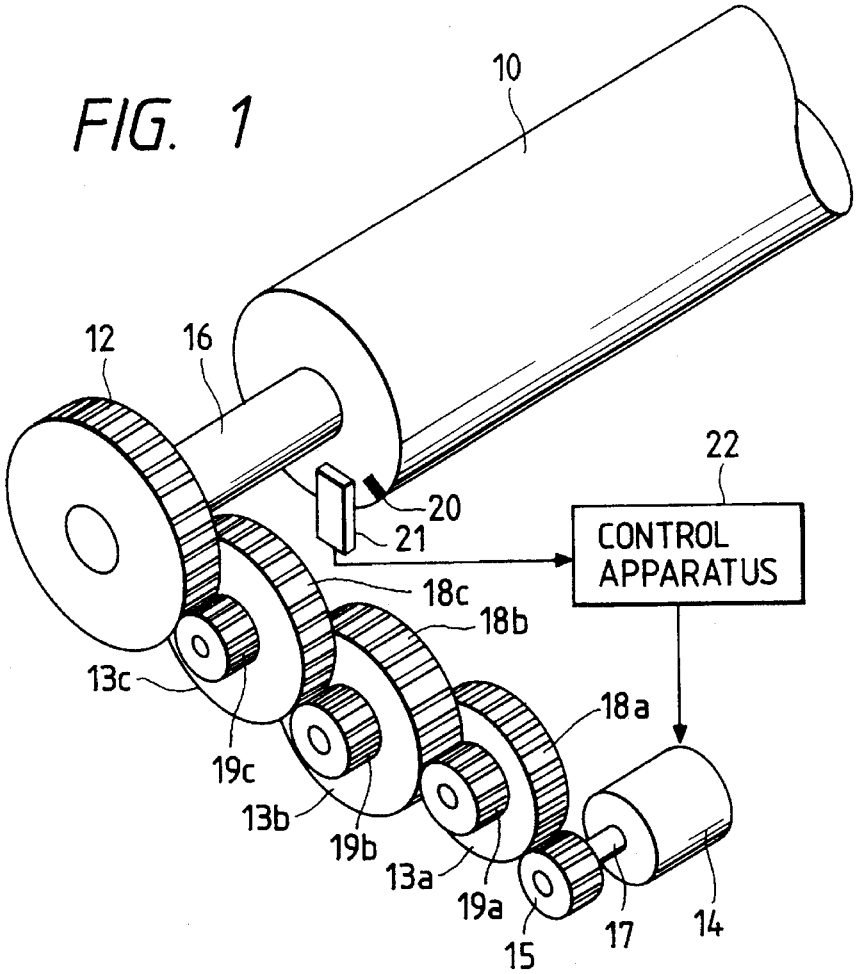
FIG. 1 is a schematic perspective view showing part of a paper feeding apparatus for a printer according to a first preferred embodiment of the present invention.
Figure 2A:
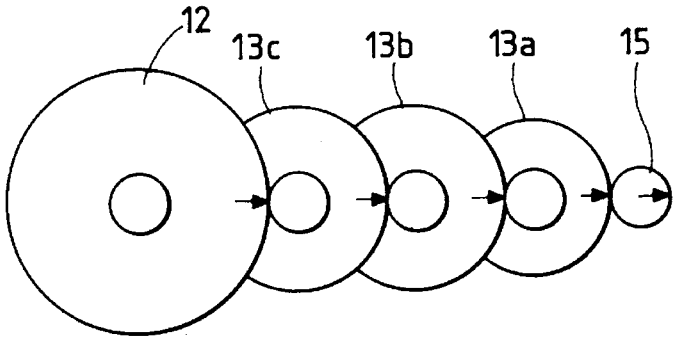
FIG. 2A is a diagrammatic view showing the positions of gears of the paper feeding apparatus for a printer of FIG. 1 when a paper feeding operation is started and FIG. 2B is a similar view but showing the positions of the gears when the paper feeding operation is completed.
Figure 2B:
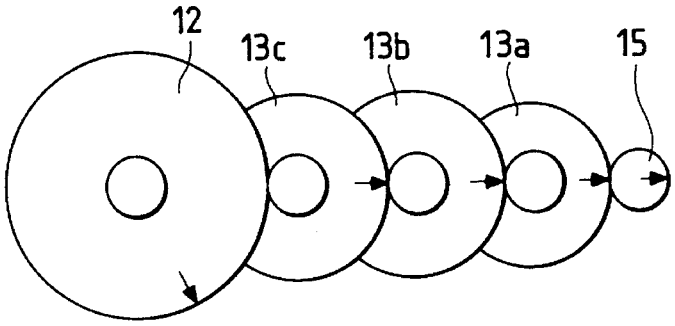

FIGS. 1, 2A and 2B show a preferred embodiment of a paper feeding apparatus for a printer according to the present invention. A cylindrical paper feed roller 10 which also serves as a platen of the printer is disposed for rotation, and a carriage not shown on which a predetermined print head is mounted is disposed in front of of the paper feed roller 10 for back and forth movement along the paper feed roller 10.

A paper feed gear 12 is mounted coaxially at an end portion of a rotary shaft 16 of the paper feed roller 10, and a paper feed motor 14 in the form of a stepping motor for driving the paper feed roller 10 to rotate is disposed in the proximity of the paper feed gear 12. A motor gear 15 is securely mounted on a shaft 17 of the paper feed motor 14. The motor gear 15 and the paper feed gear 12 are connected to each other by way of a first transmission gear 13*a*, a second transmission gear 13*b* and a third transmission gear 13*c*. Each of the transmission gears 13*a*, 13*b* and 13*c* has a large gear portion 18 (18*a* to 18*c*) formed on an outer periphery thereof and has a small gear portion 19 (19*a* to 19*c*) formed coaxially with the large gear portion 18 thereon. The motor gear 15 is held in meshing engagement with the large gear portion 18*a* of the first transmission gear 13*a*; the small gear portion 19*a* of the first transmission gear 13*a* is held in meshing engagement with the large gear portion 18*b* of the second transmission gear 13*b*; the small gear portion 19*b* of the second transmission gear 13*b* is held in meshing engagement with the large gear portion 18*c* of the third transmission gear 13*c*; and the small gear portion 19*c* of the third transmission gear 13*c* is held in meshing engagement with the paper feed gear 12. Consequently, rotation of the paper feed motor 14 is transmitted to the paper feed gear 12 at a reduced speed by way of the transmission gears 13*a*, 13*b* and 13*c*.

Further, in the present embodiment, the gear ratio of the transmission gears 13*a*, 13*b* and 13*c* is set so that, when the paper feed roller 10 is driven to rotate by an amount equal to a one line feed distance, the transmission gears 13*a*, 13*b* and 13*c* may stop normally at respective rotation starrting positions.

For example, in order to perform paper feeding with a fixed one line feed distance of 10.16 mm, where the resolution of the paper feed motor 14 is 18°; the resolution in paper feeding is 2,400 dpi; and the length of the outer periphery of the paper feed roller 10 is 50.8 mm and one full rotation of the paper feed roller 10 feeds a paper sheet by a distance equal to five line feed distances, the gear ratio of the motor gear 15, the transmission gears 13*a*, 13*b* and 13*c* and the paper feed gear 12 is set to 3:4:4:5. More particularly, where the motor gear 15 has 14 teeth, the number of teeth of the large gear portion 18*a* of the first transmission gear 13*a*should be set to 42: the number of teeth of the small gear portion 19*a* should be set to 14; the number of teeth of the large gear portion 18*b* of the second transmission gear 13*b* should be set to 56; the number of teeth of the small gear portion 19*b* should be set to 14; the number of teeth of the large gear portion 18*c* of the third transmission gear 13*c* should be set to 56; the number of teeth of the small gear portion 19*c* should be set to 14; and the number of teeth of the paper feed gear 12 should be set to 70.

Further, a detection marker 20 serving as a detection element is formed on an outer circumferential portion of an end face of the paper feed roller 10, and a detector 21 for detecting the detection marker 20 is disposed in the proximity of the end face of the paper feed roller 10. Further, a control apparatus 22 for receiving a detection signal from the detector 21 and controlling driving of the paper feed motor 14 is provided. Thus, paper feeding is controlled by the control apparatus 22 so that it is started normally from a reference position of the paper feed roller 10 at which the detection marker 20 is detected by the detector 21.

Operation of the present embodiment will be described below.

First, in order to perform desired printing, the paper feed motor 14 is energized to rotate the paper feed roller 10 by way of the motor gear 15, the transmission gears:13*a*, 13*b* and 13*c* and the paper feed gear 12. When the detection marker 20 of the paper feed roller 10 is detected by the detector 21, the paper feed motor 14 is stopped by the control apparatus 22 in response to such detection signal from the detector 21 so that the paper feed roller 10 is positioned to its reference position.

Then, a paper sheet will be inserted until it is brought into contact with the paper feed roller 10, and the paper feed motor 14 is energized to rotate the paper feed gear 12 by way of the motor gear 15 and the transmission gears 13*a*, 13*b* and 13*c* to rotate the paper feed roller 10 to transport the paper sheet by a predetermined amount to perform line feeding of the paper sheet. Then, the carriage is driven to move and the print head is driven in response to a desired printing signal to perform desired printing on the paper sheet.

In this instance, in the present embodiment, since the gear ratio of the transmission gears 13*a*, 13*b* and 13*c* is set so that when the paper feed roller 10 is driven to rotate by an amount equal to the one line feed distance, the transmission gears 13*a*, 13*b* and 13*c* may always stop at their respective rotation starting positions, if rotation of the motor gear 15 is started from a condition shown in FIG. 2A, then until the rotation of the motor gear 15 is completed, each of the transmission gears 13*a*, 13*b* and 13*c* makes an integral number of rotations without fail as seen from FIG. 2B. Consequently, when rotation of the motor gear 15 is transmitted to the paper feed gear 12, even if the transmission gears 13*a*, 13*b* and 13*c* have errors in accuracy in dimension and/or errors in accuracy in meshing engagement between them, the transmission of the rotation is not influenced by such errors at all. Consequently, the accuracy in paper feeding can be raised remarkably. Then, the accuracy in stopping position of the paper feed gear 12 which finally determines the accuracy in paper feeding depends only upon the accuracy of the paper feed gear 12. Accordingly, the accuracy in paper feeding can be raised only by raising the accuracy of the paper feed gear 12.

For example, in the case of the detailed construction described above, when it is intended to feed a paper sheet by the one line feed distance, if 960 driving pulses are applied to the paper feed motor 14, then since the resolution of the paper feed motor 14 is 18°, the paper feed motor 14 is driven to rotate by 48 rotations. Then, as a result of such rotations of the paper feed motor 14, the motor gear 15 is driven to rotate. Since the gear ratio of the motor gear 15, the transmission gears 13*a*, 13*b* and 13*c* and the paper feed gear 12 is set to 3:4:4:5, by the rotations of the motor gear 15, the first transmission gear 13*a* is rotated by 16 rotations; the second transmission gear 13*b* is rotated by 4 rotations; and the third transmission gear 13*c* is rotated by one rotation. Consequently, the paper feed gear 12 is rotated by ⅕ rotation. In this instance, since the length of the outer periphery of the paper feed roller 10 is 50.8 mm, a paper sheet can be fed by the one line feed distance of 10.16 mm.

Accordingly, in the present embodiment, since the gear ratio of the transmission gears 13*a*, 13*b* and 13*c* is set so that, when the paper feed roller 10 is driven to rotate by an amount equal to the one line feed distance, the transmission gears 13*a*, 13*b* and 13*c* may always stop at their respective rotation starting positions, when rotation of the motor gear 15 is transmitted to the paper feed gear 12, the transmission of rotation is not influenced by errors in accuracy in dimension of and/or errors in accuracy in meshing engagement between the transmission gears 13*a*, 13*b* and 13*c*. Consequently, the accuracy in feeding of a paper sheet by the paper feed roller 10 can be raised remarkably, and there is no necessity of raising the accuracy in dimension of the transmission gears 13*a*, and 13*c* and so forth to the limit.

Further, since the detection marker 20 is detected by the detector 21 to position the paper feed roller 10 at the reference position by means of the control apparatus 22 so that paper feeding may be started normally from the reference position, when the paper feed roller 10 is rotated, it is rotationally positioned normally at one of the fixed positions. Consequently, even if the outer periphery of the paper feed roller 10 suffers from an error in dimension due to eccentricity or the like, paper feeding can be performed with a fixed error amount.

As described above, with the paper feeding apparatus for a printer according to the present invention, since the gear ratio of the transmission gears is set so that, when the paper feed roller is rotated by an amount equal to a 1/N line feed distance, the transmission gears are stopped normally at the respective rotation starting positions, when rotation of the motor gear is transmitted to the paper feed gear, the transmission of rotation is not influenced by errors in accuracy in dimension of and/of errors in meshing engagement between the transmission gears, and consequently, the accuracy in paper feeding by the paper feed roller can be raised remarkably and the accuracy in dimension of the transmission gears and so forth need not be raised to the limit. Further, since the paper feed roller is positioned normally at the reference position upon starting of paper feeding, when the paper feed roller is rotated, the paper feed roller will be rotationally positioned normally at one of the fixed positions. Consequently, even if an error in dimension occurs with the outer periphery of the paper feed roller due to eccentricity or the like, paper feeding can be performed with a fixed error amount.

Figure 3:
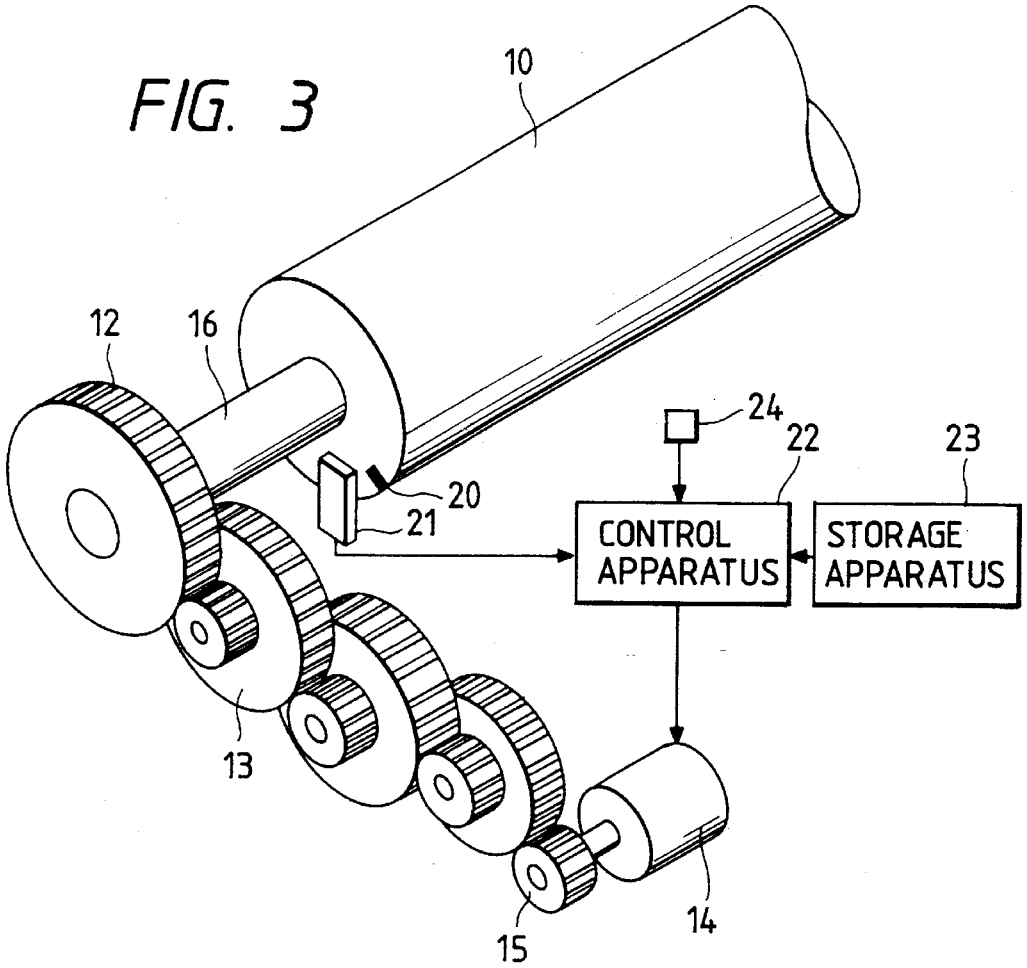
FIG. 3 is a schematic diagrammatic view showing part of a paper feeding apparatus for a printer according to a second preferred embodiment of the present invention.
Figure 6A:
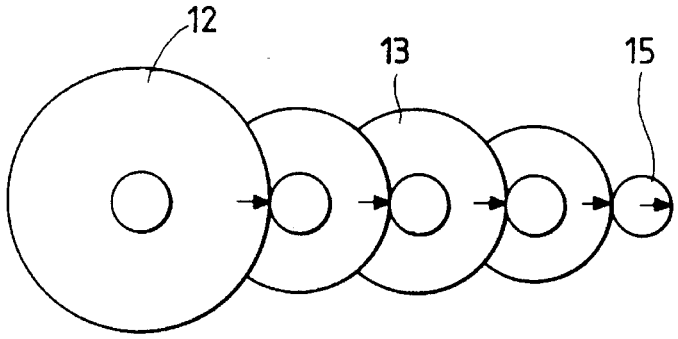
FIG. 6A PRIOR ART
FIG. 6A is a diagrammatic view showing the positions of gears of a paper feeding apparatus of the conventional printer shown in FIG. 5 when a paper feeding operation is started and FIG. 6B is a similar view but showing the positions of the gears when the paper feeding operation is completed.
Figure 6B:
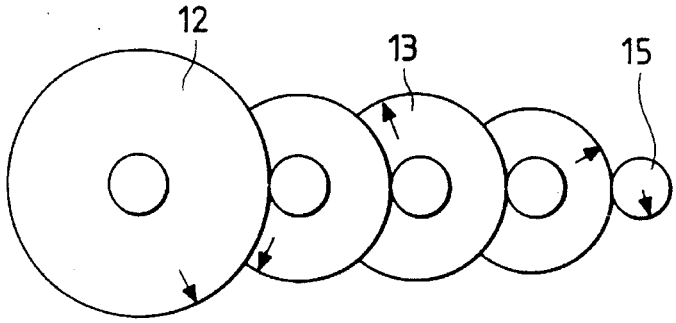
FIG. 6B PRIOR ART
Figure 4:
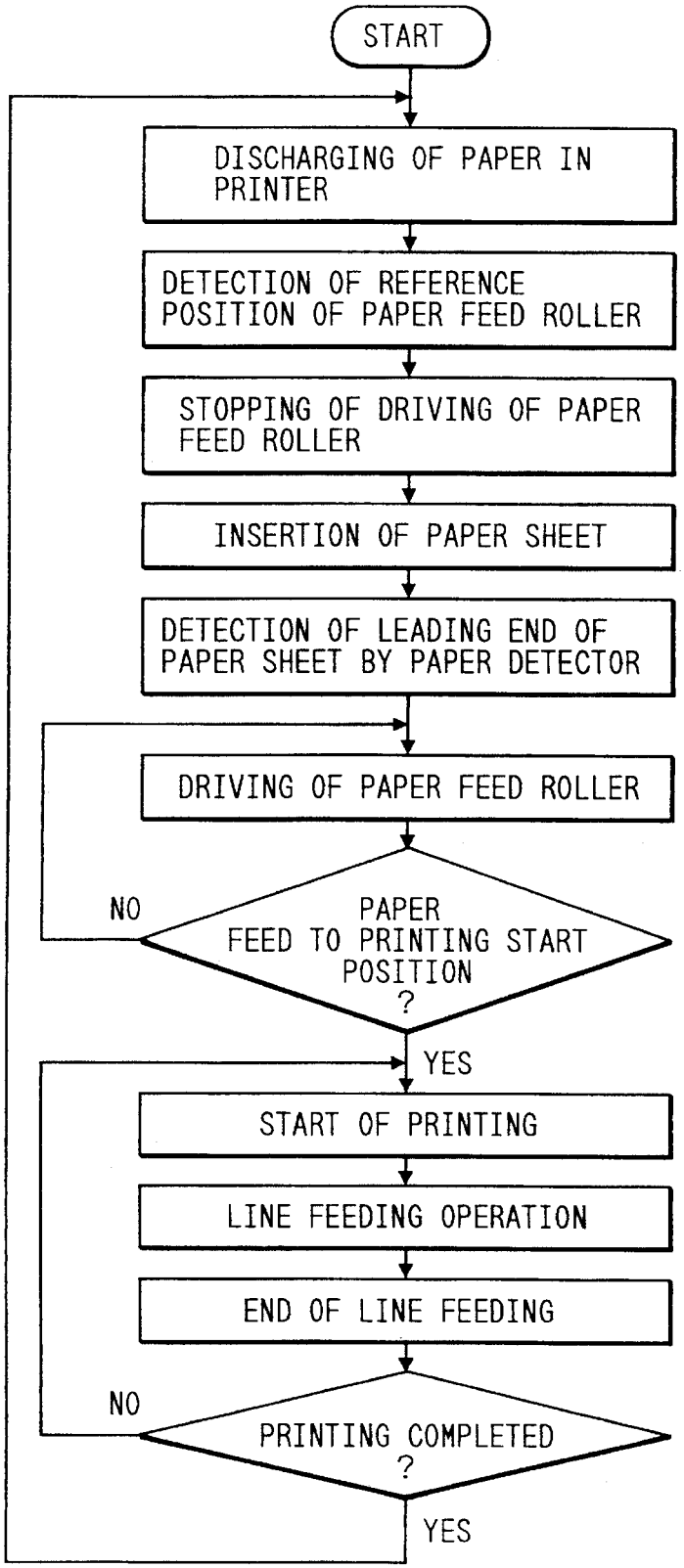
FIG. 4 is a flow cart illustrating operation of the paper feeding apparatus for a printer of FIG. 3.
Figure 5:
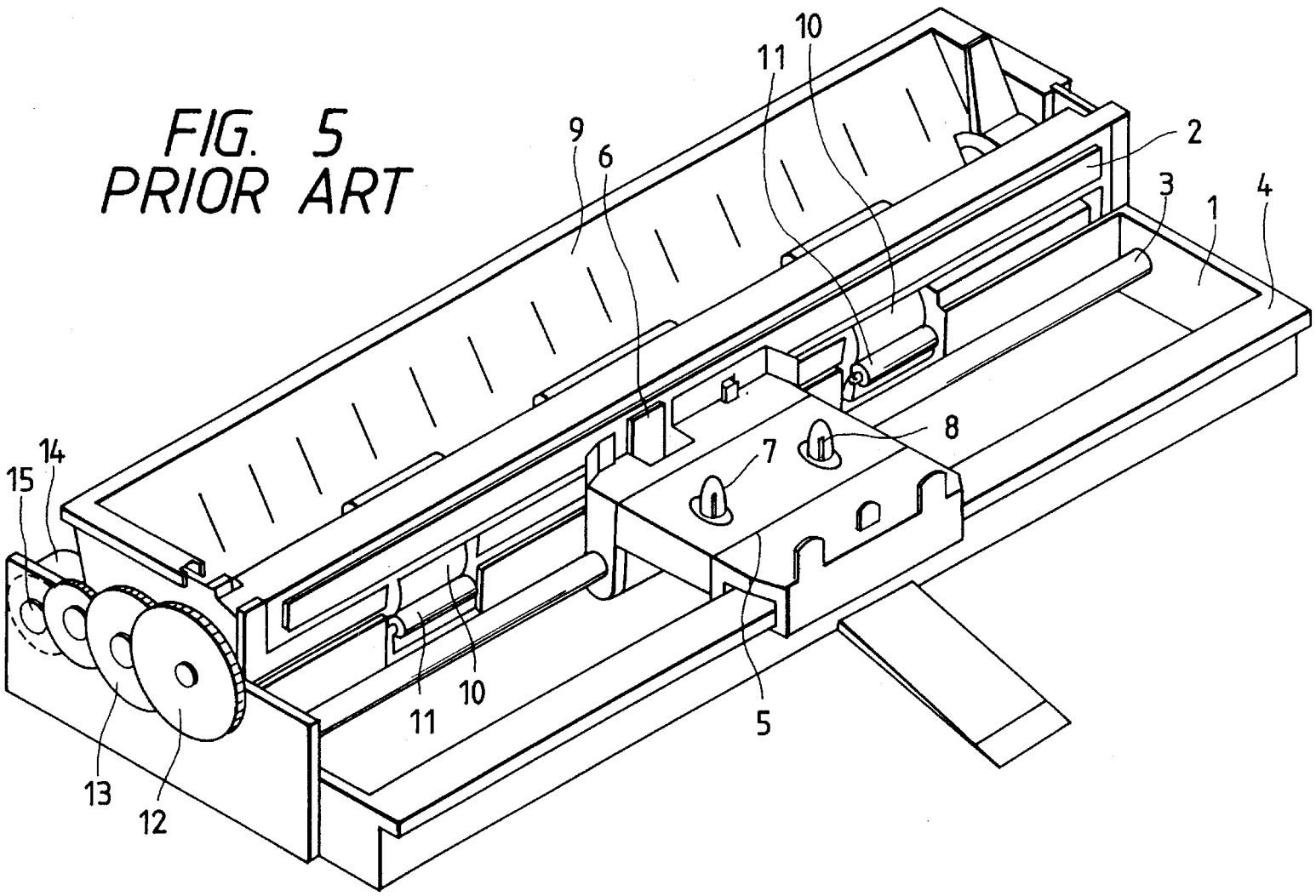
FIG. 5 PRIOR ART
FIG. 5 is a schematic perspective view showing a general construction of a conventional popular printer.

Subsequently, a second preferred embodiment of the present invention will be described with reference to FIGS. 3 and 4. It is to be noted that like elements to those of the first embodiment are denoted like reference numerals in FIG. 3.

FIG. 8 shows another preferred embodiment of a paper feeding apparatus for a printer according to the present invention. A cylindrical paper feed roller 10 which serves also as a platen of the printer is disposed for rotation, and a carriage not shown is disposed forwardly of the paper feed roller 10 for back and forth movement along the paper feed roller 10. Further, a print head not shown is carried on the carriage in an opposing relationship to the paper feed roller 10. The print head is brought into and out of contact with a paper sheet, which is transported by the paper feed roller 10, by controlling the amount of rotation of a can mechanism not shown.

Further, in the present embodiment, the length of the outer periphery of the paper feed roller 10 is set equal to the length of N line feed distances. For example, when a line feeding operation of a fixed one line feed distance of 10.16 mm is performed, the length of the outer periphery of the paper feed roller 10 is set to 50.8 mm so that a paper sheet is fed by five line feed distances by one full rotation of the paper feed roller 10.

A paper feed gear 12 is mounted coaxially at an end portion of a rotary shaft 16 of the paper feed roller 10, and a paper feed motor 14 such as a stepping motor for driving the paper feed roller 10 to rotate is disposed in the proximity of the paper feed gear 12. A motor gear 15 is securely mounted on a shaft 17 of the paper feed motor 14, and the motor gear 15 and the paper feed gear 12 are connected to each other by way of a plurality of (three in the present embodiment) transmission gears 13. Further, in the present embodiment, the gear ratio of the motor gear 15 is set so that the paper feed gear 12 can be driven to rotate by an amount equal to the one line feed distance when the motor gear 15 rotates by a plural number (integral number) of times. Consequently, when the paper feed motor 14 is energized to rotate the motor gear 15 by a predetermined amount by a plurality of times, the rotation is transmitted to the paper feed gear 12 at a reduced speed by way of the transmission gears 13 to rotate the paper feed gear 12 by an amount equal to the one line feed distance.

Further, a detection marker 20 serving as a detection element is formed on an outer circumferential portion of an end face of the paper feed roller 10, and a reference position detector 21 for detecting the detection marker 20 is disposed in the proximity of the end face of the paper feed roller 10. Further, a paper detector 24 for detecting presence or absence of a paper sheet being transported is disposed on the upstream side of a printing position defined by the print head. The paper detector 24 is particularly disposed at a position at which the distance over which a paper sheet is fed to the printing position after it is detected by the paper detector 24 is substantially equal to an integral number (including 1) of times the one line feed distance.

Furthermore, in the present embodiment, a control apparatus 22 is provided which receives a detection signal from the reference position detector 21 and another detection signal from the paper detector 24 and controls driving of the paper feed motor 14. A storage apparatus 23 such as a memory is connected to the control apparatus 22. The storage apparatus 23 stores in advance the numbers of driving pulses of the paper feed motor 14 corrected in accordance with a measurement amounts obtained by measuring errors of the one line feed distance of the paper feed roller 10 so that the amounts of a paper sheet to be fed when line feeding operations by the one line feed distance are performed by rotation of the paper feed roller 10 may be fixed values in accordance with an eccentric condition of the paper feed roller 10. For example, where the length of the outer periphery of the paper feed roller 10 is set to 50.8 mm so that a paper sheet may be fed by five line feed distances by one rotation of the paper feed roller 10 as described hereinabove, the amount of rotation of the paper feed roller 10 is corrected so that a paper sheet may be fed accurately by 10.16 mm by a one line feeding operation, and the numbers of driving pulses necessary for such amounts of rotation are stored into the storage apparatus 23. Such corrected driving pulse numbers are stored by a quantity (number) equal to the number of N line feeding operations of the one line feed distance, that is, a quantity for one full rotation of the paper feed roller 10. Thus, the control apparatus 22 controls the number of driving pulses to be outputted to the paper feed motor 14 in response to each of the corrected driving pulse numbers stored in the storage apparatus 23.

Subsequently, operation of the present embodiment will be described with reference to the flow chart of FIG. 4.

First, in order to perform desired printing, the paper feed motor 14 is energized to rotate the paper feed roller 10 by way of the motor gear 15, the transmission gears 13 and the paper feed gear 12 until any paper sheet remaining in the inside of the printer is discharged outside. Then, when the detection marker 20 of the paper feed roller 10 is detected by the reference position detector 21, the paper feed motor 14 is stopped by the control apparatus 22 in response to such detection signal from the reference position detector 21 to position the paper feed roller 10 at the reference position.

Then, a paper supply mechanism not shown is rendered operative to feed a predetermined paper sheet until a leading end portion of it is detected by the paper detector 24, and then the paper feed roller 10 is energized to feed the paper sheet to a printing start position to thus perform indexing of the paper sheet. In this instance, in the present embodiment, since the distance from the paper detector 24 to the printing start position is set equal to an integral number of times the one line feed distance, the paper sheet can be fed accurately in accordance with a corrected paper feeding amount by controlling the number of driving pulses to be outputted to the paper feed motor 14 in response to a corresponding one of the corrected driving pulse numbers stored in the storage apparatus 23. For example, where the distance from the paper detector 24 to the printing start position is set equal to the one line feed distance, the paper feed motor 14 is driven in accordance with a first one of the corrected driving pulse numbers stored in the storage apparatus 23.

Then, the carriage is driven while the print head is driven in response to a desired printing signal to perform desired printing on the paper sheet. After printing of one line is completed, the paper feed motor 14 is driven in accordance with a second one of the corrected driving pulse numbers stored in the storage apparatus 23 by the control apparatus 22 to rotate the paper feed roller 10 by an amount equal to the one line feed distance to thus perform line feeding of the paper sheet.

When line feeding is formed in this manner, the paper feed motor 14 is driven to rotate the paper feed roller 10 successively in accordance with one of the corrected driving pulse numbers stored in the storage apparatus 23, and after the paper feed roller 10 rotates by one full rotation as a result of N line feeding operations by repetition of the line feeding operation described above, the line feeding operation is successively performed in response to the corrected driving pulse numbers stored in the storage apparatus 23 beginning with the first one of the corrected driving pulse number.

Accordingly, in the present embodiment, since the paper feed motor 14 is successively driven in response to driving pulses of the numbers stored in advance in the storage apparatus 23 to perform paper feeding from a condition wherein the detection marker 20 is detected by the reference position detector 21 and the paper feed roller 10 is positioned at the reference position by the control apparatus 22, even if the paper feed roller 10 is formed in a somewhat eccentric condition, a paper sheet can be fed accurately in accordance with the corrected paper feeding amounts, and consequently, the accuracy in paper feeding by the paper feed roller 10 can be raised remarkably. Further, in the present embodiment, since the length of the outer periphery of the paper feed roller 10 is set equal to N line feed distances and only the corrected driving pulses numbers for N successive line feeding operations are stored in the storage apparatus 23, the storage apparatus 23 may have a small storage capacity, and besides, control data based on the corrected driving pulse numbers of the storage apparatus 23 can be produced rapidly.

As described above, with the paper feeding apparatus for a printer according to the present invention, following advantages are provided. In particular, since the paper feed motor is successively driven in response to driving pulses of the numbers stored in advance in the storage apparatus to perform paper feeding from a condition wherein the detection marker is detected by the reference position detector and the paper feed roller is positioned at the reference position by the control apparatus, even if the paper feed roller is formed in a somewhat eccentric condition, a paper sheet can be fed accurately in accordance with the corrected paper feeding amounts, and consequently, the accuracy in paper feeding by the paper feed roller can be raised remarkably. Further, in the present embodiment, since the length of the outer periphery of the paper feed roller is set equal to N line feed distances and only the corrected driving pulses numbers for N successive line feeding operations are stored in the storage apparatus, the storage apparatus may have a small storage capacity, and besides, control data based on the corrected driving pulse numbers of the storage apparatus can be produced rapidly.

What is claimed is:

1. A paper feeding apparatus for transporting a recording sheet in a feeding direction within a printer, the printer including a print head for printing indicia onto the recording sheet, the printed indicia being formed on print lines spaced apart in the feeding direction by a predetermined line feed distance, the paper feeding apparatus comprising:

a stepping motor including a motor gear;

at least one transmission gear meshed with the motor gear; and a paper feed roller for transporting the recording sheet, the paper feed roller including a paper feed gear meshed with the transmission gear such that rotation of the stepping motor by a predetermined number of rotations is transmitted through the transmission gear to rotate the paper feed roller, thereby causing the recording sheet to move in the feeding direction over the predetermined paper feed distance;

wherein an outer peripheral length of said paper feed roller is equal to N times the predetermined line space distance, where N is an integer; and wherein the motor gear, the transmission gear and the paper feed gear have gear ratios selected such that both the transmission gear and the motor gear rotate integral numbers of times and stop at predetermined rotation starting positions each time the paper feed roller is rotated to transport the recording sheet over the predetermined line space distance.

2. The paper feeding apparatus according to claim 1, further comprising:

a detection element formed on said paper feed roller and indicating a reference position of said paper feed roller;

a detector for detecting said detection element and generating a detection signal; and a controller for receiving the detection signal from said detector and controlling driving of said paper feed motor so that, upon starting a paper feeding operation, said paper feed roller is positioned at the reference position.

3. The paper feeding apparatus according to claim 2, further comprising:

means for storing corrected driving pulse numbers for said paper feed motor corresponding to a plurality of line feed positions, wherein the stored corrected driving pulse numbers are transmitted to the controller for adjusting the paper feed motor in successive positions in accordance with the corrected driving pulse numbers.

4. The paper feeding apparatus for a printer according to claim 3, further comprising a paper detector for detecting presence or absence of the recording sheet being transported, said paper detector being disposed at a location on the upstream side of the printing position in the paper feeding direction at which the distance from the printing position is substantially equal to an integral number of times the predetermined line feed distance.

* * * * *